United States Patent [19]

Moses

[11] 4,084,357

[45] Apr. 18, 1978

[54] VALVE CLEANING MACHINE

[75] Inventor: Robert W. Moses, Council Grove, Kans.

[73] Assignee: Peterson Machine Tool, Inc., Merriam, Kans.

[21] Appl. No.: 789,787

[22] Filed: Apr. 22, 1977

[51] Int. Cl.[2] ..... B24C 3/22

[52] U.S. Cl. ..... 51/419; 51/412; 51/426

[58] Field of Search ..... 51/412, 419, 426, 436, 51/437; 134/79, 80, 81, 153, 158, 161

[56] References Cited

U.S. PATENT DOCUMENTS

| | | | |
|---|---|---|---|
| 1,875,994 | 9/1932 | Davis | 51/419 X |
| 2,307,816 | 1/1943 | Zimmerman | 51/426 X |
| 2,310,488 | 2/1943 | Guite | 51/426 X |
| 2,431,354 | 11/1947 | Wallberg | 51/426 X |
| 2,456,984 | 12/1948 | Mueller | 134/80 X |
| 3,906,674 | 9/1975 | Stone | 51/426 |

FOREIGN PATENT DOCUMENTS

| | | | |
|---|---|---|---|
| 1,245,332 | 9/1960 | France | 51/426 |

*Primary Examiner*—Gary L. Smith
*Attorney, Agent, or Firm*—John A. Hamilton

[57] ABSTRACT

A valve cleaning machine consisting of a cabinet in which are mounted a plurality of jet nozzles adapted to eject compressed air jets containing granular abrasive material, each adapted to clean a given peripheral portion of an automotive engine valve. The valves to be cleaned are mounted in a rotating carousel so that each valve is presented sequentially to each of the nozzles, and the valves are rotated in the carousel to insure that the entire periphery of each valve is presented to each nozzle. The nozzles may be operated simultaneously if sufficient compressed air capacity is available, or one at a time in sequence if only a lesser compressed air capacity is available. The polished bearing surfaces of the valve stems are protected from the abrasive air blasts, and provision is made for alternative use of the device for cleaning single hand-held objects when desired.

5 Claims, 6 Drawing Figures

VALVE CLEANING MACHINE

Figure 1:
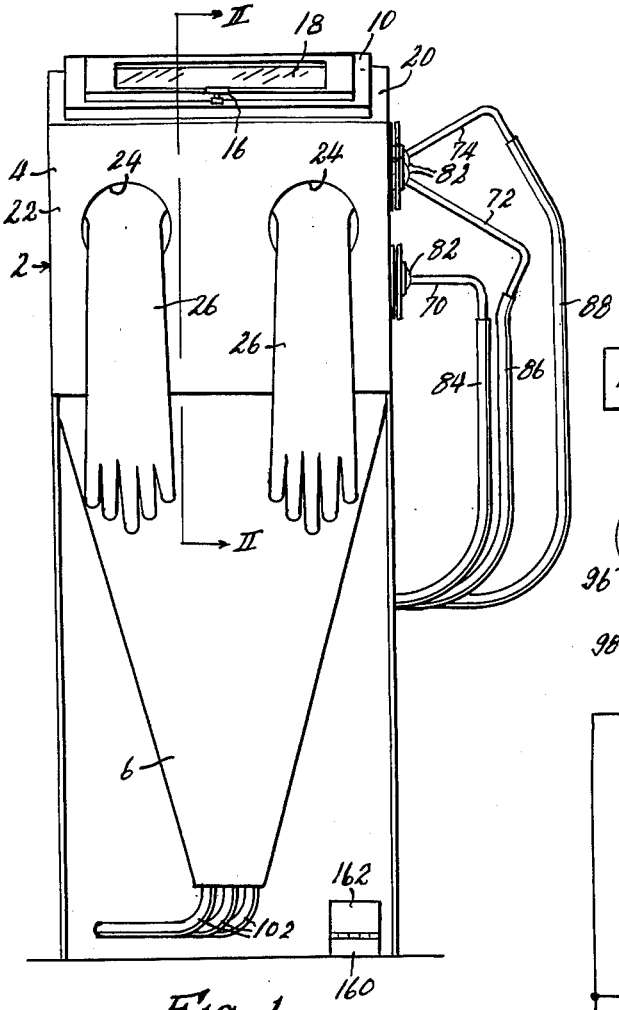

This invention relates to new and useful improvements in machines for cleaning the valve members of internal combustion engines of the carbon deposits, corrosion and the like with which said valves become fouled. The present machine is of course intended for use primarily in engine rebuilding and repair shops.

It has long been common practive to clean valves by subjecting them to a blast of compressed air containing an abrasive granular or powdered material such as very small glass beads, aluminum oxide or the like. Usually the air blast nozzle is contained in a closed, windowed cabinet, and each valve is handled manually within the cabinet by an operator using glove ports, being turned by hand so that all parts of its surface are presented to the abrasive blast and cleaned. This prior system is subject to certain disadvantages. When a large number of valves must be cleaned, the prior one-at-a-time handling is obviously tedious and time-consuming, and hence expensive in labor costs, and it also almost inevitably resulted in subjection of the polished bearing areas of the valve stem to the abrasive blast, with resultant roughening thereof, unless said stems are specially wrapped or otherwise protected.

Accordingly, a primary object of the present invention is the provision of a special valve carrier, herein denoted a carousel, mounted movably in the cabinet, and in which may be mounted a relatively large number of valves, and which is driven by power means to present the valves sequentially to the nozzles. Each nozzle cleans effectively for only a short distance from its outlet, before the air velocity is dissipated. Therefore each nozzle can effectively clean only one valve at a time, but the movement of the carousel presents the valves susccessively to the nozzles.

Obviously, unless the valve movement pattern is made quite complex, no single nozzle can clean the entire area of a valve, and accordingly another object is the provision of a valve cleaning machine of the character described including a plurality of nozzles collectively operable to reach all portions of a valve to be cleaned and requiring only a simple rotary movement of the carousel. Usually this will require at least three nozzles, one for the top surfaces of the valve heads, one for the bottom surfaces, and one for the peripheral edge surfaces.

A further object is the provision of means whereby the valves are not only moved by the carousel, but are also turned relative to the carousel itself, so that in repeated revolutions of the carousel, all portions of the valve periphery will be presented in operative relationship to the nozzles, thereby further insuring thorough cleaning.

Since each nozzle requires an air compressor of approximately 3 horsepower, or about 15 horsepower if three nozzles are used, and further since many automotive shops do not have compressors of this capacity, a still further object is the provision of a novel control system permitting simultaneous operation of all of the nozzles if sufficient air compressor capacity is available, but also permitting one-at-a-time but sequential operation of the nozzles in a predetermined pattern. Thus virtually all of the advantages of the present device are available even with a limited compressor capacity available, with the exception that sequential nozzle operation requires a longer total time period of operation.

Still another object is the provision of a machine of the character described wherein the carousel is readily removable from the cabinet, the cabinet is provided with glove ports, and the control system permits foot-pedal operation of a single nozzle, thus permitting alternative usage of the device for cleaning single hand-held objects whenever desired.

Other objects are relative simplicity and economy of construction, and efficiency and dependability of operation.

Figure 6:
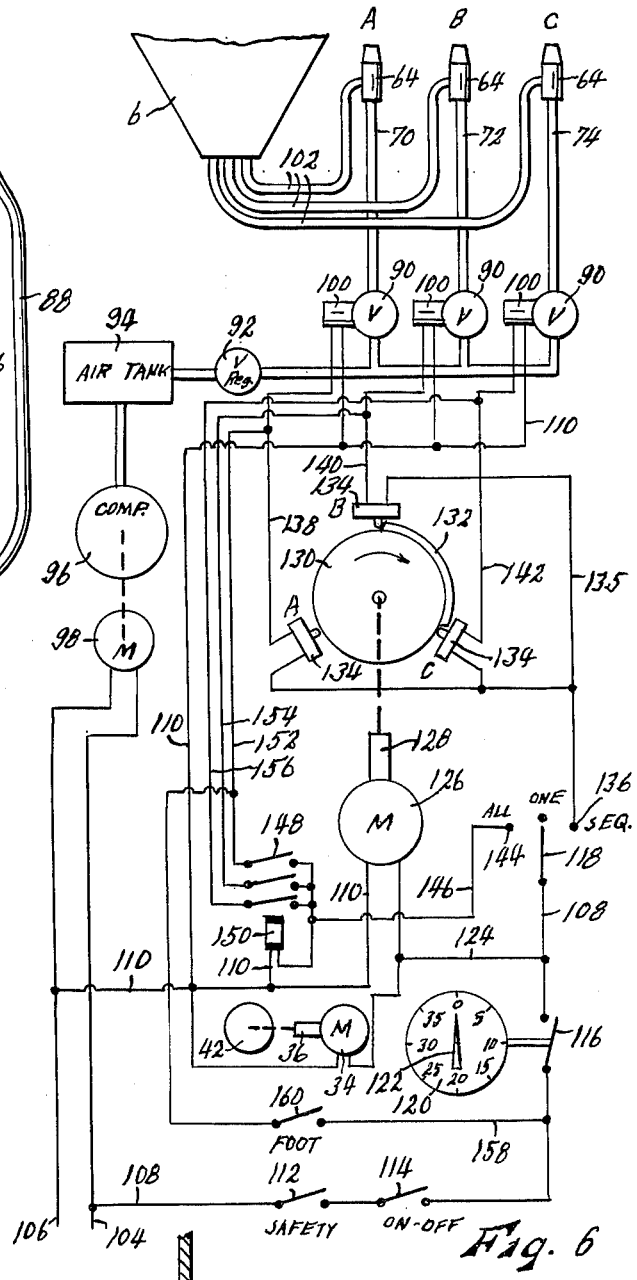
Figure 5:
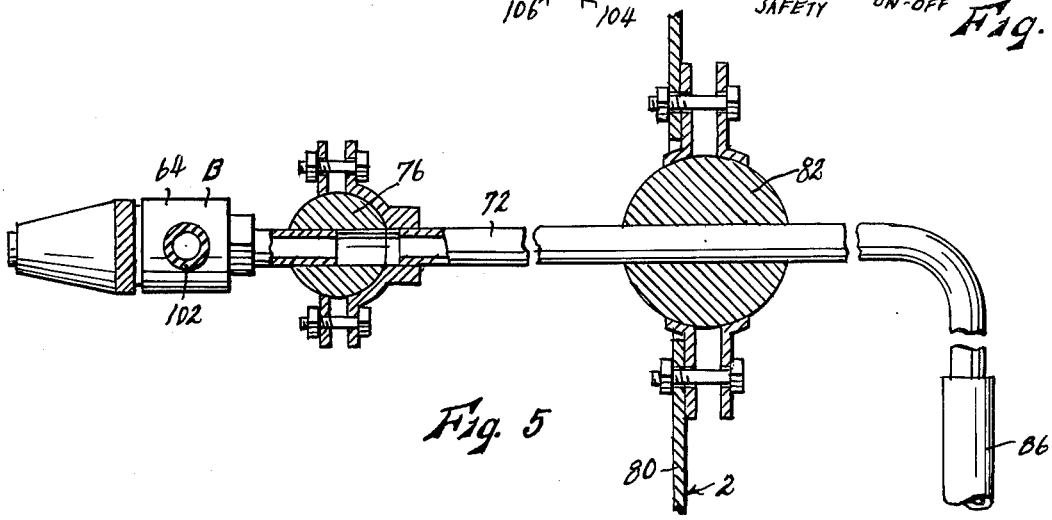
Figure 2:
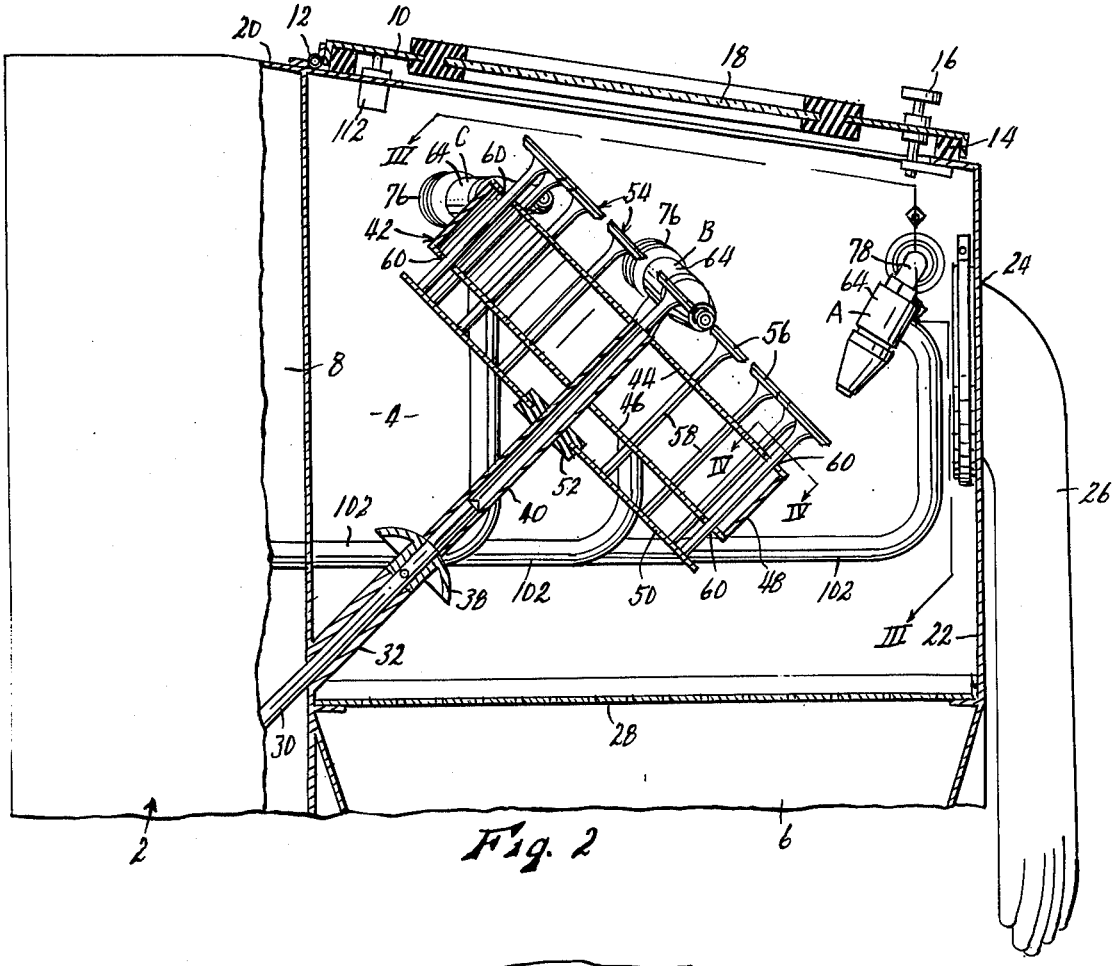
Figure 3:
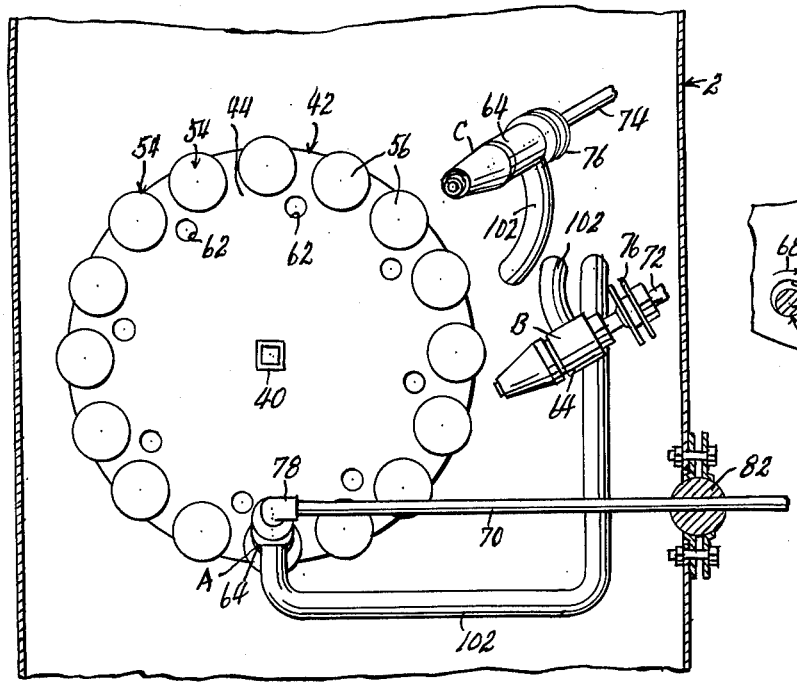
Figure 4:
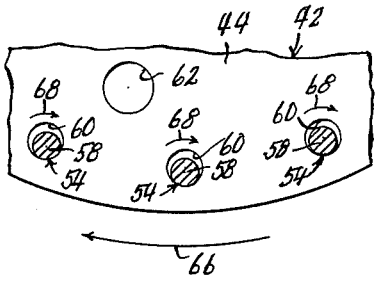

With these objects in view, as well as other objects which will appear in the course of the specification, reference will be had to the accompanying drawing, wherein:

FIG. 1 is a front elevational view of a valve cleaning machine embodying the present invention, FIG. 2 is an enlarged, fragmentary sectional view taken on line II—II of FIG. 1, FIG. 3 is a somewhat irregular sectional view taken generally on line III—III of FIG. 2, FIG. 4 is an enlarged, fragmentary sectional view taken on line IV—IV of FIG. 2, FIG. 5 is an enlarged, longitudinal sectional view of the mounting of one of the air jet nozzles in the cabinet, partially broken away and foreshortened, and FIG. 6 is a schematic diagram of the control system of the machine.

Like reference numerals apply to similar parts throughout the several views, and the numeral 2 applies generally to the cabinet or housing of the valve cleaning machine forming the subject matter of the present invention. Said cabinet is upright and generally rectilinear, forming a cleaning chamber 4 in the upper forward portion thereof, a hopper 6 disposed below and communicating with said cleaning chamber, and a chamber 8 disposed behind the cleaning chamber and hopper, and extending the full height of the cabinet. Chamber 8 may contain various operating and control devices to be described. Access to the interior of cleaning chamber 4 is provided by a top door 10 which is hinged to the top wall 20 of the cabinet at 12, provided with a sealing gasket 14, and secured releasably closed by a manually operable latch 16. Said door is also provided with a transparent window 18 through which the interior of the cleaning chamber may be observed. In the front wall 22 of the cleaning chamber there are provided a pair of glove port openings 24 around the periphery of each of which is sealed the cuff of a flexible glove 26. The gloves are shown disposed externally of the cleaning chamber, where they would normally be during use of the valve carrying carousel, but may be everted to extend into the cleaning chamber for receiving the hands and arms of an operator for hand-holding objects to be cleaned within the chamber. The floor of cleaning chamber 4 is formed by a tray 28 of expanded or perforated metal or the like to permit the granular abrasive material to pass downwardly therethrough into hopper 6.

Extending upwardly and forwardly into cleaning chamber 4, generally from the lower rear corner thereof, is a carousel drive shaft 30, said shaft being journalled in a bearing 32 fixed to the cabinet, and extending into rear cabinet chamber 8, where it is rotatably driven by an electric motor 34 through a geared speed reducer 36 to turn at a suitable speed, say one or two revolutions per minute. At the inner end of bearing 32, a shield 38 is affixed to the shaft to prevent the entry of abrasive material into the bearing, and the extreme extending end portion of said shaft, above shield 38, is squared to receive slidably but non-rotatably thereon the square tubular stem 40 of a valve carrying carousel indicated generally by the numeral 42. Stem 40 extends to the central zone of chamber 4, and besides said stem, carousel 42 includes a pair of circular plates 44 and 46 affixed coaxially to said stem in axially spaced apart relation thereon, a cylindrical wall 48 extending between and affixed to the peripheral edges of said plates, and a circular support plate 50 of the same diameter as plates 44 and 46 mounted coaxially on stem 40 beneath plate 46 by means of a soft rubber grommet 52 which provides frictional engagement with the stem to permit adjustment of said plate along said stem.

Carousel 42 is adapted to carry a number of engine valves 54 to be cleaned. As shown, each of said valves normally comprises a flat circular head 56 and a valve stem 58 projecting coaxially from said head. Carousel plates 44 and 46 have matching series of circular holes 60 formed therethrougn, said holes being regularly spaced in a circular pattern adjacent the peripheries of said plates. The stem 58 of each valve is inserted downwardly through a matching pair of holes 60, so that its lower end rests on support plate 50, and its head 56 is spaced above plate 44, as best shown in FIG. 2. If all of the valve stems are of equal length, the valve heads 56 will be disposed in a common plane.

Each valve stem has a portion of its area, starting in spaced relation below head 56 and extending to the free end of said stem, which constitutes a polished bearing area when the valve is in operation in an engine, and this bearing area should not be subjected to the abrasive blasts of the cleaning machine, since they would be roughened thereby. To prevent this occurrence, support plate 50 is adjusted, after the valves have been inserted, by sliding grommet 52 frictionally along stem 40, until the bearing surfaces of the stems are all disposed below plate 44, within the cage formed by plates 44 and 46 and cylindrical wall 48, or below said cage, where as will appear they are not subject to abrasive air blasts. Fo reasons to be described, it is essential that the valve stem holes 60 of plates 44 and 46 be of substantially larger diameter than the stems extending therethrough, as shown in FIG. 4. Said plates may also be provided with another ring of valve stem holes 62, holes 62 being of greater diameter than holes 60, but arranged in a circle of smaller diameter. Holes 62 are for receiving the stems of larger valves, having heads and stems of greater diameters than valves 54.

Disposed in cleaning chamber 4 are a plurality of air jet nozzles 64, each adapted to direct a jet of air containing abrasive particles against the valves carried in carousel 42. To reach all portions of the valves to be cleaned, with the carousel arranged as shown, requires three of nozzles 64, which for convenience will be further designated as nozzles A, B and C. Nozzle A is directed downwardly toward the top surface of the valve heads, nozzle B is directed against the peripheral edges of the valve heads, substantially in the plane of the valve heads, the nozzle C is directed upwardly against the lower surfaces of the valve heads. Each nozzle must be disposed quite close to the valve surface it is cleaning, since at greater distances the jet velocity is dissipated. Therefore each nozzle is effective relative to only one valve at a time, but as the carousel turns through one full revolution, each valve is presented in operative relation to each of the nozzles. Also, each nozzle is effective against only the surface of the valve confronting it, not the valve surfaces turned away from it. Even nozzle A, directed at the top surfaces of the valve heads, is capable of cleaning only a portion of said top surface in one pass of the valve thereby. Therefore, provision is made not only for turning the carousel itself, but also for turning each valve relative to the carousel. As shown in FIG. 4, it will be seen that as the carousel is turned in the direction of arrow 66, the engagement of valve stems 58 with the edges of the larger holes 60 causes said stem to roll around the peripheries of said holes as the carousel turns, whereby the valves rotate relative to the carousel, in the direction of arrows 68. Of course, the stems must engage the edges of holes 60 by gravity to provide this rotation, and it is for this reason that the carousel must be tilted, as best shown in FIG. 2. The angle of tilt, however, is not critical. In this manner, a different portion of the periphery of each valve is presented to each nozzle in each rotation of the carousel. In the case of nozzle A, it is directed at the top valve head surfaces eccentrically thereto, so that as the valve turns in the carousel, a different portion of said surface is cleaned by nozzle A in each turn of the carousel. Thus in several turns of the carousel, all of the surfaces of the valves to be cleaned will have been presented in operative relation to the nozzles. This arrangement of the carousel, and the movement of the valves therein, is an important feature of the present invention. The chance that a given valve might be rotated to the same position relative to the carousel, in different passes of that valve by a given nozzle, is extremely remote, since the circumferences of holes 60 relative to the valve stems carried therein may be proportioned to prevent it, and since the rotation of the valve stems in the holes is not even and uniform, due to irregular slippage of the lower ends of the valve stems on support plate 50.

Nozzles A, B and C are supported and supplied with air by air pipes 70, 72 and 74 respectively. Each nozzle may be connected to its air supply pipe by a universally pivotable ball socket joint 76, as best shown in FIG. 5, in connection with nozzle B, although in some cases this is not necessary and the nozzle may be connected directly to its air pipe, as by a simple elbow 78 as shown in FIGS. 2 and 3 in connection with nozzle A. Air pipes 70, 72 and 74 extend outwardly of the cabinet through a side wall 80 of cleaning chamber 4, each extending for longitudinal sliding movement through a spherical ball 82 clamped for frictional universal pivoting in said side wall. By means of this sliding movement, and the pivotal movement of balls 76 and 82, the three nozzles may be brought into proper relationship to the valves in carousel 42. Of course, this normally necessitates that in any one loading of the carousel, only valves of a single size, all inserted in one set of the holes 60 or 62, may be serviced. Connected respectively to the outer ends of said air pipes are flexible hoses 84, 86 and 88, by means of which, and other conduits, each of nozzles A, B and C is connected through a normally closed solenoid valve 90, and a single pressure regulating valve 92, to the air storage tank 94 of an air compressor 96 driven by an electric motor 98. Each of valves 90 is opened by energization of its solenoid 100. Each of nozzles A, B and C is of an aspirator type, capable of sucking abrasive particles carried in hopper 6 upwardly through a flexible siphon tube 102 connected at one end to the bottom of said hopper to receive abrasive particles stored in said hopper, said hoses extending into cleaning chamber 4, and each being connected into one of the nozzles laterally thereof, whereby to inject said particles into the air stream passing through said nozzle. Tubes 102 have sufficient slack therein to permit the described adjustable movement of the nozzles.

The operating and control system of the machine is schematically diagrammed in FIG. 6. A pair of electric line wires 104 and 106 deliver electric power to compressor motor 98. Said motor, compressor 96 and air tank 94 are not normally carried in cabinet 2. They may be provided with standard controls, not shown, whereby, up to the capacity of the compressor, a constant air pressure will be maintained in tank 94 despite the removal of air therefrom at any rate. Power for all other functions flows from line wire 104 through wire 108, and returns to line wire 106 through return wire 110. Starting from wire 104, wire 108 has interposed therein in series a safety switch 112 which is normally open but which, as indicated in FIG. 2, is closed mechanically by closure of top door 10 of the cabinet, then a manually operable on-off switch 114, then a normally open timer switch 116, and finally to the common contact of a double-throw selector switch 118 having a center off position. Timer switch 116 is closed by a mechanical connection thereof to a mechanical timer 120 which is of a common type, including a pointer 122 movable on a graduated dial to any desired number of minutes and allowed to return to a zero position by a spring clockwork, and operable to maintain switch 116 closed until the pointer does return to zero. Intermediate switches 116 and 118, wire 108 is connected by wire 124 to one terminal of the motor 34 which turns carousel 42, and to one terminal of an electric motor 126 which acts through a geared speed reducer 128 to turn a rotary sequential switch operating device 130. The opposite terminals of motors 34 and 126 are connected to return wire 110, so that said motors operate whenever switches 112, 114 and 116 are closed.

Switch operator 130 comprises a disc driven by motor 126, and having a peripheral lobe 132 operable to close each of three normally open micro-switches 134 mounted adjacent the rim of said disc, in a continuously repetitive sequence as the disc is turned. Only one of switches 134 is closed at any given instant, and the disc is preferably turned at such a speed that each switch is closed for approximately one third of each rotation of carousel 42.

One terminal of each of switches 134 are all connected to one of the side terminals 136 of selector switch 118 by wire 135, and the opposite terminals of said switches are connected respectively by wires 138, 140 and 142 to one terminal each of solenoids 100 of solenoid valves 90. The opposite terminals of all of the solenoids are connected to return wire 110. The other side terminal 144 of selector switch 118 is connected by wire 146 to one contact of each of the three poles of a three-pole relay 148, and to one terminal of the relay coil 150, the energization of which closes said relay. The opposite terminal of the coil is connected to return wire 110, and the opposite contacts of the three relay poles are connected respectively by wires 152, 154 and 156 to the wires 138, 140 and 142 supplying solenoids 100. A wire 158 extends from wire 108 intermediate switches 114 and 116, and is connected to wire 152 feeding one of solenoids 100, preferably that controlling front nozzle A, through a normally open foot switch 160 which may be closed by a foot pedal 162 disposed conveniently to an operator standing in front of the cabinet (see FIG. 1). Valves 90, motors 34 and 126, and the various items of switchgear may conveniently be mounted in rear chamber 8 of the cabinet, with the manual control members of switches 114, 116 and 118 exposed externally of the cabinet at any convenient portion of the cabinet, for example at the top wall 20 thereof, behind top door 10.

In operation, carousel 42 is engaged over the squared portion of shaft 30, and loaded with valves 54 by inserting their stems 58 through corresponding holes 60 or 62 of carousel plates 44 and 46 and resting said stems at their lower ends on support plate 50, as previously described. As previously discussed, valves of only one size, all mounted in either holes 60 or holes 62, but not both, should be included in one batch. Support plate 50 is adjusted slidably along stem 40 of the carousel until the bearing areas of stems 58 are disposed completely beneath top plate 44 of the carousel, so that they are protected against the blasts of the abrasive-carrying air blasts of the nozzles. Nozzles A, B and C are adjusted as previously described to direct their jets against the desired portions of the valves, at the proper spacing therefrom, also as previously described. Top door 10 of the cabinet is then closed, which closes safety switch 112, and control switch 114 is closed manually. The nozzles cannot function at all unless door 10 is closed, thus preventing possible painful injury to the operator. Pointer 122 of timer 120 is then manually turned to a position on the timer dial indicating the desired number of minutes of operation, thus closing timer switch 116 for that period of time, and selector switch 118 is set for the desired type of operation. The closure of switch 116 activates carousel drive motor 34 to cause rotation of carousel 42, and also activates motor 126 to cause rotation of the operating disc 130 of sequential switch 134, whereby lobe 132 of said disc closes the three switches 134 corresponding respectively to nozzles A, B and C in a continuously repetitive cycle as the disc rotates at a uniform speed.

If selector switch 118 has been set on contact 136, then the closure of each switch 134 completes the operating circuit of the solenoid 100 of the solenoid valve 90 of the corresponding nozzle A, B or C, opening said valve to pass a stream of air through and outwardly from said nozzle, said air stream aspirating abrasive material from hopper 6 through the corrresponding tube 102 to be entrained in said air stream. In this type of operation, only one of the nozzles is operative at any given moment. If, on the other hand, selector switch 118 has been set on contact 144, then sequential switches 134 become inoperative though disc 130 continues to rotate, but the operative circuit of relay coil 150 is completed, causing all three poles of relay 148 to close, to complete the circuits of solenoids 100 of all three of valves 90 simultaneously, so that all three of nozzles A, B and C function at the same time.

Whether sequential or simultaneous operation of the nozzles is employed will depend ordinarily on the air compressor capacity which may be available. The simultaneous operation of course provides for the cleaning of a batch of valves in a much shorter time period, as reflected by the setting of timer 120, but simultaneous operation of three nozzles may require a 15 horsepower air compressor, with which few automotive shops are equipped. On the other hand, sequential operation can be carried out with perhaps a 3 horsepower compressor, with which most shops are already equipped. Therefore, in the interests of economy, and to negative any requirement that the user purchase a special air compressor, the alternative operation provided by the present device is a valuable innovation.

If selector switch 118 is set on its central blind position, then the described sequential or simultaneous operations are not possible, but one of the nozzles, in this case nozzle A, may be actuated by closing foot switch 160, which completes the operating circuit of solenoid 100 of the corresponding solenoid valve 90. This type of operation may be used to clean objects which cannot be mounted in the carousel. To employ it the operator would normally lift the carousel out of the cabinet, and hand-hold an object to be cleaned within the cabinet by the use of gloves 26 and glove ports 24. For safety, it requires that door 10 be closed to close safety switch 112, but does not require closure of timer switch 160. Therefore, motors 34 and 126 do not operate. Foot switch 160 could of course be wired to activate more than one of the nozzles, if sufficient air compression capacity is available.

Thus it will be seen that a valve cleaning machine having several advantages has been produced. In distinction to machines in which each member must be hand-held and turned before a cleaning nozzle jet, it provides for the virtually simultaneous cleaning of a relatively large number of valves. As shown, the device provides for the cleaning of 16 valves in one batch, but this is a matter of choice. A larger carousel could carry more valves. A plurality of nozzles are required to reach all the surfaces of a valve supported in a cabinet, but the present machine, by its use of a special moving carousel and means for turning the valves relative to the carousel, provides that all of the valve surfaces to be cleaned, of all the valves, may be reached by a minimum number of nozzles. It also protects those surfaces of the valves which should not be subjected to the cleaning jets. The use of a plurality of nozzles would normally require a multiplication of the compressed air capacity, as compared to that required for a single nozzle, but the present device, by providing for sequential operation of the nozzles, may be operated with no more compressed air capacity than is required for a single nozzle. At the same time, the nozzles may be operated simultaneously, for greater speed and cleaning capacity, if sufficient compressed air capacity is available.

While I have shown and described a specific embodiment of my invention, it will be readily apparent that many minor changes of structure and operation could be made without departing from the spirit of the invention.

What I claim as new and desire to protect by Letters Patent is:

1. A machine for cleaning valves of automotive engines, each valve comprising a flat circular head and an integral cylindrical stem projecting coaxially from said head, said machine comprising:

a. a cabinet, b. a jet nozzle positioned within said cabinet and operable when actuated to eject a jet of air containing particles of abrasive material, c. a carousel carried within said cabinet for rotation on its axis, said carousel comprising a generally cylindrical cage and having a circular pattern of holes formed therethrough, said holes being parallel to and equidistant from the cage axis, one end wall of said cage facing upwardly, d. a support plate carried by said carousel beneath and parallel to the bottom of said cage, each of said valves being mountable in said carousel by slidably inserting its stem downwardly through one of the holes of the cage and resting it at its lower end on said support plate, with the valve head disposed in spaced relation above the top of the cage, said nozzle being directed toward the periphery of the circle of valve heads of the valves inserted in the carousel so as to be disposed in operative relation to the head of the closest of said valves, whereby as said carousel turns, all of said valve heads are presented successively in operative relation to said nozzle, said support plate being adjustably movable relative to said cage in a direction toward and from the lower end wall of said cage, whereby the length of the portions of the valve stems disposed between the valve heads and the upwardly facing end wall of the cage way be adjusted, e. means operable to rotate said carousel, and f. means operable to actuate said nozzle.

2. A machine for cleaning valves of automotive engines, each valve comprising a flat, circular head and an integral cylindrical stem projecting coaxially from said head, said machine comprising:

a. a cabinet, b. a jet nozzle positioned within said cabinet and operable when activated to eject a jet of air containing particles of abrasive material, c. a carousel carried within said cabinet, said carousel being circular and mounted in said cabinet for rotation on its axis, and comprising a cylindrical cage coaxial with the axis of rotation of the carousel and having holes formed therethrough parallel to its axis and in a circular pattern concentric with its axis, one end wall of said cage facing upwardly, and a support plate carried by said carousel beneath and parallel to the other end wall of said cage, each of said valves being mountable in said carousel by inserting its stem downwardly through one of the holes of said cage and resting it at its lower end on said support plate, with the valve head disposed in spaced relation above the upwardly facing end wall of said cage, said nozzle being directed toward the periphery of the circle of the heads of the valves carried by the caraousel so as to be disposed in operative relation to the closest of said valve heads, whereby as said carousel turns all of said valve heads are presented successively in operative relation to said nozzle, the axis of said carousel being vertically inclined, whereby the stems of the valves rest by gravity against the edges of the cage defining the holes through which said stems are inserted, said holes being circular and of larger diameter than said stems, whereby as said cage is rotated about its own axis, each of said valve stems is rotated about its own axis, in a reverse direction, by its rolling engagement with said hole-defining edges so that a different portion of the periphery of each valve is presented in operative relation to said nozzle in each turn of said carousel, d. means operable to rotate said carousel, and e. means operable to actuate said nozzle.

3. The machine as recited in claim 2 wherein said carousel includes an axial stem mounted in said cabinet in a vertically inclined position and operable to be rotated on its axis by said carousel rotating means, said cage being fixed concentrically on the upper end portion of said stem and including a pair of spaced end plates normal to said stem, and a cylindrical wall joining the peripheries of said end plates, said end plates having corresponding sets of said stem-receiving holes formed therethrough, and said support plate being mounted on said stem beneath and parallel to the lower end plate of said cage, said support plate being adjustably movable along said carousel stem to vary the spacing thereof from said cage.

4. A machine for cleaning valves of automotive engines comprising:

a. a cabinet, b. a plurality of jet nozzles positioned within said cabinet and each operable when actuated to eject a jet of air containing particles of abrasive material, c. a carousel carried within said cabinet, said carousel being circular and mounted in said cabinet for rotation on its axis, and being operable to support a plurality of valves to be cleaned in a circular pattern adjacent the periphery thereof, and each of said nozzles being directed toward a portion of the valve head closest thereto of the valves carried by said carousel, in operative relation thereto, and each being positioned to direct its jet against a portion of the surface of said valve head which does not pass in operative relation to any other nozzle, whereby as said carousel turns the same portions of all said valve heads are presented successively in operative relation to each of said nozzles, d. means operable to rotate said carousel, and, e. means operable to actuate said nozzles, said nozzle actuating means being operable to actuate said nozzles one at a time, in a continuously repetitive cycle.

5. The machine as recited in claim 4 wherein said nozzle actuating means is operable selectively either to actuate all of said nozzles simultaneously, or to actuate said nozzles one at a time, in a continuously repetitive cycle.

* * * * *